United States Patent [19]

Diaz-Noriega

[11] Patent Number: 4,682,140

[45] Date of Patent: Jul. 21, 1987

[54] MINIATURE PLUG IN FUSE

[76] Inventor: Jose M. Diaz-Noriega, Apartado Postal 3020, 64000 Monterrey, N.L., Mexico

[21] Appl. No.: 894,940

[22] Filed: Aug. 8, 1986

[51] Int. Cl.[4] ..... H01H 85/14; H01H 85/16

[52] U.S. Cl. ..... 337/260; 337/255; 337/290; 337/295

[58] Field of Search ..... 337/255, 256, 257, 260, 337/261, 262, 263, 290, 295, 407

[56] References Cited

U.S. PATENT DOCUMENTS 4,349,804 9/1982 Gaia ..... 337/295

*Primary Examiner*—Harold Broome

*Attorney, Agent, or Firm*—Solon B. Kemon

[57] ABSTRACT

Small plug-in electrical fuses, e.g., for automotive use are formed with a fusible link portion which is partially cut but with the walls of the cut in substantial electrical contact with each other and opposite ends of each link rigidly supported. Initial heating of the link due to current flow in excess of the fuse rating causes bending of the link to open the cut, reducing the available cross-section for current flow and therefore greatly shortening the time necessary to open the link and minimizing the total heat generated in the process.

3 Claims, 4 Drawing Figures

FIG. 1
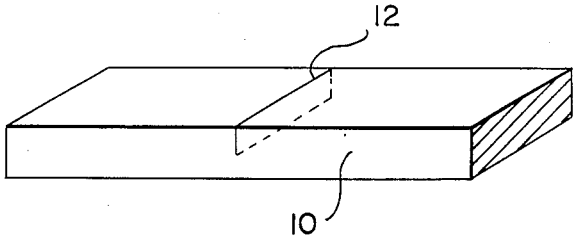
FIG. 2
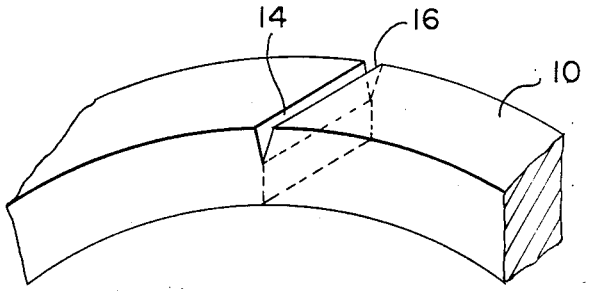
FIG. 4
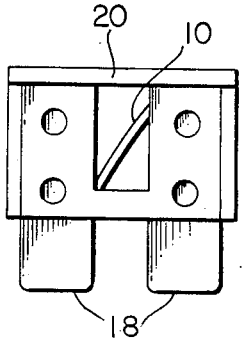
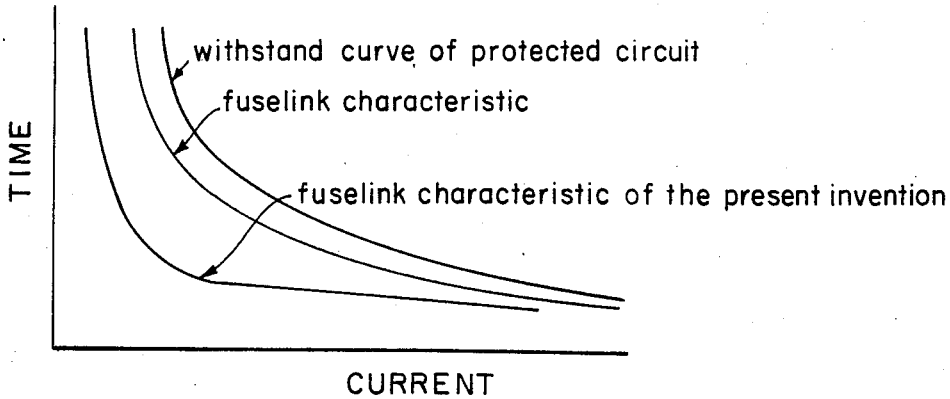
FIG. 3

MINIATURE PLUG IN FUSE

BACKGROUND OF THE INVENTION

Small electrical fuses of the plug in type commonly used in automotive vehicles currently comprise a pair of flat spaced parallel terminals connected by a fusible link. The metallic portions are surrounded and supported by a plastic housing with the terminals extending outwardly thereof. A typical example may be found in U.S. Pat. No. 4,349,804. When the current through such fuses rises above the fuse rating, the fusible link melts to open the circuit. Since considerable heat is generated as the link temperature rises to the melting point, the melting point of the surrounding plastic must be sufficiently higher than the temperatures generated by the melting of the link to prevent melting of the plastic and flowing into the adjacent parts of the fuse block or other components. The price differential between low and high melting point plastics is very substantial and since the manufacture and sale of such fuses is highly competitive, it would be to the advantage of the manufacturer to be able to use the lowest melting point plastics possible and still avoid the possibility of melting under actual fuse opening conditions.

BRIEF SUMMARY OF THE INVENTION

The amount of heat generated by the melting of a fusible link in response to a predetermined overload is greatly reduced by providing a fusible link which has a cut extending partially through the cross section of the link such that at least a portion of the side walls of the cut remain in electrical contact with each other at ambient temperature. Opposite ends of the link are rigidly supported by the terminals of the fuse and the surrounding plastic housing. In response to a predetermined current rise above the fuse rating, initial $I^2R$ losses in the link cause it to bend which separates the side walls of the cut, reducing the cross section of the link which raises its resistance and increases the rate of heating. This results in more rapid opening of the link and therefore a much lower total heat output than would be the case with a link, the cross section of which remains substantially constant up to the point of opening. This permits use of much cheaper lower melting point plastic for the housing while avoiding melting of the plastic during opening of the fusible link

BRIEF DESCRIPTION OF THE DRAWINGS

FIG. 1 is a diagrammatic showing of a fuse link in accordance with the present invention, with opposite ends rigidly supported;

FIG. 2 is a view of the same link as FIG. 1 after bending due to $I^2R$ losses of a predetermined current flow therethrough, but prior to opening of the link;

FIG. 3 is a graph of Current vs. Time showing the relation of a fuse of the present invention to those of the prior art; and FIG. 4 is a front elevation of a plug-in fuse in accordance with the present invention.

DETAILED DESCRIPTION OF THE DRAWINGS

Referring now to FIG. 1, the fusible link 10 is shown as a rectangular parallelopiped with opposite ends rigidly supported with respect to each other. A cut indicated by the reference numeral 12 extends partially through the cross section of the fuse at a point intermediate the opposite ends. The side walls of the cut 12 are in at least partial electrical contact with each other so that the electrical resistance of the link is substantially the same as a link of the same dimensions without the cut. FIG. 1 represents the condition of the fuse link 10 at ambient temperature corresponding to normal current flow therethrough. FIG. 2 shows the same link following the start of current flow in excess of the fuse rating. Initial heating of the link due to such current flow, since the ends of the link are fixed, results in expansion and, therefore, bending of the link and separation of the side walls 12 and 16 of the cut 12. This reduces the effective cross section of the link raising its resistance to the flow of curren therethrough and greatly increases the rate of heating. The total time necessary for melting of the link due to flow of current above the rating of the fuse is therefore, greatly reduced and the link will open without generating enough heat to cause melting of the surrounding plastic. A much lower melting point and therefore, much cheaper plastic material may be used which means that the fuses can be produced at substantially lower manufacturing costs.

Referring to FIG. 3, this shows a comparison of the fuse link characteristics of the prior art and that of the present invention. The bottom curve of FIG. 3 shows a time current characteristic which bends much more sharply than that of the prior art fuses. This means that between 110% of normal current, which is the holding point and 135% which is the opening point, the fuse will either hold with moderate heat or open in a time substantially the same as the 135% time. The fuse of this invention therefore, will either remain in moderate heat (around 70° to 80° C. above ambient) or it will open in a few minutes. The plastic housing does not have time to warm up to its melting point and therefore permits the use of plastics which on a per pound basis sell for about 1/10th of the ones currently used such as polysulfone.

FIG. 4 merely shows a complete plug-in fuse with the connector terminals 18 extending from the plastic body 20.

While a preferred embodiment of the present invention has been herein shown and described, it is contemplated that there will be many variations within the scope of this invention such as more than one cut, cuts which are diagonal to the axis of the link rather than perpendicular as shown, etc. Applicant therefore, claims the benefit of a full range of equivalents within the scope of the appended claims.

I claim:

1. A fuse for opening an electrical circuit in response to a predetermined current flow comprising:

a plastic housing;

a pair of spaced conductive terminals supported in and extending outwardly from said housing for connection into an electrical circuit;

a fusible link within said housing electrically connected to said terminals and rigidly supported at its opposite ends thereby; and means defining at least one cut extending partially through said link, at least a portion of the side walls of said cut being in electrical contact with each other at ambient temperature, but separable from each other in response to current generated heat causing bending of said link reducing the cross section of the link and raising its electrical resistance.

2. A fuse as defined by claim 1 in which at least a major portion of the side walls of said cut are in electrical contact with each other at ambient temperature.

3. A fuse as defined by claim 1 in which said link is a solid rectangular parallelopiped and said cut is parallel to and spaced substantially equally from the end faces thereof.

* * * * *